US008616899B1

(12) United States Patent
Lin

(10) Patent No.: US 8,616,899 B1
(45) Date of Patent: Dec. 31, 2013

(54) CONTACT TYPE OF ELECTRIC CONNECTION BUILDING BLOCK

(71) Applicant: Chia-Yen Lin, Dongguan (CN)

(72) Inventor: Chia-Yen Lin, Dongguan (CN)

( * ) Notice: Subject to any disclaimer, the term of this patent is extended or adjusted under 35 U.S.C. 154(b) by 0 days.

(21) Appl. No.: 13/745,679

(22) Filed: Jan. 18, 2013

(51) Int. Cl.
*H01R 12/00* (2006.01)

(52) U.S. Cl.
USPC ..... 439/63; 439/928

(58) Field of Classification Search
USPC ..... 439/63, 928; 446/91
See application file for complete search history.

(56) References Cited

U.S. PATENT DOCUMENTS 5,054,474 A * 10/1991 Jacob et al. ..... 601/160
7,322,873 B2 * 1/2008 Rosen et al. ..... 446/91
2013/0109268 A1 * 5/2013 Lin ..... 446/91

* cited by examiner

*Primary Examiner* — Phuong Dinh

(57) ABSTRACT

A contact type of electric connection building block includes a base, electric connection posts and a top cover. The base includes recesses defined in a bottom thereof and a circuit board disposed on a top thereof. First and second connection circuits and an electronic component are formed on the circuit board. The electric connection posts are mounted on the circuit board. Each electric connection post has an exterior sheath and an interior post disposed in and insulated from the exterior sheath. The exterior sheath and the interior post each is made of a conductive material and includes a contact portion. The contact portions of the exterior sheath and the interior post are located at the same level and respectively connected with the first and second connection circuits. The top cover is mounted on the base.

11 Claims, 16 Drawing Sheets

CONTACT TYPE OF ELECTRIC CONNECTION BUILDING BLOCK

BACKGROUND OF THE INVENTION

1. Field of the Invention

The present invention relates generally to an electric connection building block, and in particular to a contact type of electric connection building block capable of reducing the numbers of components and omitting soldering processes when assembling.

2. The Prior Arts

Building blocks are a popular toy which allows players to construct anything, ranging from robot to airplane. There are various types of building blocks developed by manufacturers to provide more variety of the toy. Now, there are electric connection building blocks available in the market. The electric connection building block includes electronic components, such as LED lights or audio components, and electric connection posts disposed therein. When a plurality of electric connection building blocks are connected with each other, the electronic components are electrically connected by electric connection posts, such that the electrically connected electronic components would emit light or play sound, which provides more entertainment and fun.

Referring to FIGS. 9 to 11, a conventional electric connection building block includes a base 50, a plurality of electric connection posts 60 and a top cover 70. A plurality of recesses 51 are defined in a bottom of the base 50 and a circuit board 52 is disposed on a top of the base 50. The circuit board 52 has a light member 53 (or an audio member for an audio building block) and a set of connection circuit (not shown in drawings) mounted thereon.

The electric connection posts 60 are mounted on the circuit board 52 of the base 50 and includes a positive conducting member 61 and a negative conducting member 62. The positive and negative conducting members 61 and 62 have metal leads 611 and 621, respectively. The metal leads 611 and 621 are soldered on the circuit board 52 and connected with the light member 53 by the connection circuit of the circuit board 52.

The top cover 70 is hollow and light transmittable. The top cover 70 is mounted on the top of the base 50 and the electric connection posts 60 are received in the top cover 70. A top of the top cover 70 has a plurality of hollow studs 71 corresponding to tops of the electric connection posts 60 and communicating with an inner space of the top cover 70.

When the studs 71 of the top cover 70 of the electric connection building block are inserted into the recesses 51 of the base 50 of another electric connection building block, the positive and negative conducting members 61 and 62 of the electric connection building block would connect with corresponding positive and negative conducting members 61 and 62 of another electric connection building block, thereby connecting the light members 53 of the electric connection building blocks in parallel. Referring to FIG. 11, the positive conducting member 61 includes two contact pins 63 and a spring 64. The two pins 63 are disposed at top and bottom ends of the electric connection post 60, respectively. The spring 64 is received in the electric connection post 60 and bias between the two contact pins 63, thereby making the two contact pins 63 be projected out of the top and bottom ends of the electric connection post 60. The spring 64 is connected with the metal lead 611. The negative conducting member 62 includes a conical spring 65 and a metal connection wire 66 connected with the conical spring 65. The conical spring 65 is disposed at the top of the connection post 60 and sleeved around one of the contact pins 63. The metal connection wire 66 is disposed adjacent to the electric connection post 60. A lower part of the metal connection wire 66 includes a bent portion 67 and a lower end of the metal connection wire 66 is connected with the metal lead 621 of the negative conducting member 62. When two electric connection building blocks are connected with each other, the contact pin 63 disposed at the bottom of the electric connection building block is contacted with the contact pin 63 disposed at the top of another electric connection building block, and the bent portion 67 disposed at the bottom of the electric connection building block is contacted with the conical spring 65 disposed at the top of another electric connection building block. Therefore, the positive conducting members 61 in two electric connection building blocks are connected with each other and the negative conducting members 62 in two electric connection building blocks are connected with each other.

As mentioned above, the positive and negative conducting members 61 and 62 have a complex structure and a lot of components. It is hard to assemble and time consuming. Moreover, the metal leads 611 and 622 of the positive and negative conducting members 61 and 62 need to be soldered on the circuit board 52. Not only labor consuming, but also it would cause environmental contamination. Therefore, there are problems need to be solved.

SUMMARY OF THE INVENTION

A primary objective of the present invention is to provide a contact type of electric connection building block that overcomes the disadvantages of conventional designs that needs to solder the metal leads of the electric connection post to the circuit board which is labor consuming and causing environmental contamination.

Another objective of the present invention is to provide a contact type of electric connection building block that reduces the numbers of components and is easy to assemble.

In order to achieve the objective, a contact type of electric connection building block according to the present invention includes a base, a plurality of electric connection posts and a top cover.

The base includes a plurality of recesses defined in a bottom thereof and a circuit board disposed on a top thereof. A first connection circuit, a second connection circuit and an electronic component connected with the first and second connection circuits are formed on the circuit board.

The electric connection posts are mounted on the circuit board and bottoms of the electric connection posts are disposed in the corresponding recesses. Each of the electric connection posts has an exterior sheath and an interior post vertically disposed in the exterior sheath. The exterior sheath and the interior post are made of a conductive material. The exterior sheath and the interior post each includes a first insertion portion disposed at a top thereof and a second insertion portion corresponding to the first insertion portion and disposed at a bottom thereof. The exterior sheath has a contact portion and a through hole, so that the contact portion is pressed against the first connection circuit of the circuit board. An insulator is provided between the exterior sheath and the interior post to electrically insulate the exterior sheath from the interior post. Furthermore, the interior post has a contact portion to be projected out of the through hole of the exterior sheath and pressed against the second connection circuit.

The top cover is hollow and light transmittable. The top cover is mounted on the top of the base and includes a plurality of hollow studs disposed on a top thereof. The studs correspond to tops of the electric connection posts and communicate with an inner space of the top cover. The top of each electric connection post is received in and pressed against the corresponding hollow stud.

The aforementioned electric connection post uses the contact portions to contact and connect with the first and second connection circuits without any soldering process, which prevents the environmental contamination. Furthermore, the electric connection post only needs the exterior sheath and the interior post to assemble. It greatly reduces the numbers of components, simplifies assembling processes and reduces assembling time.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
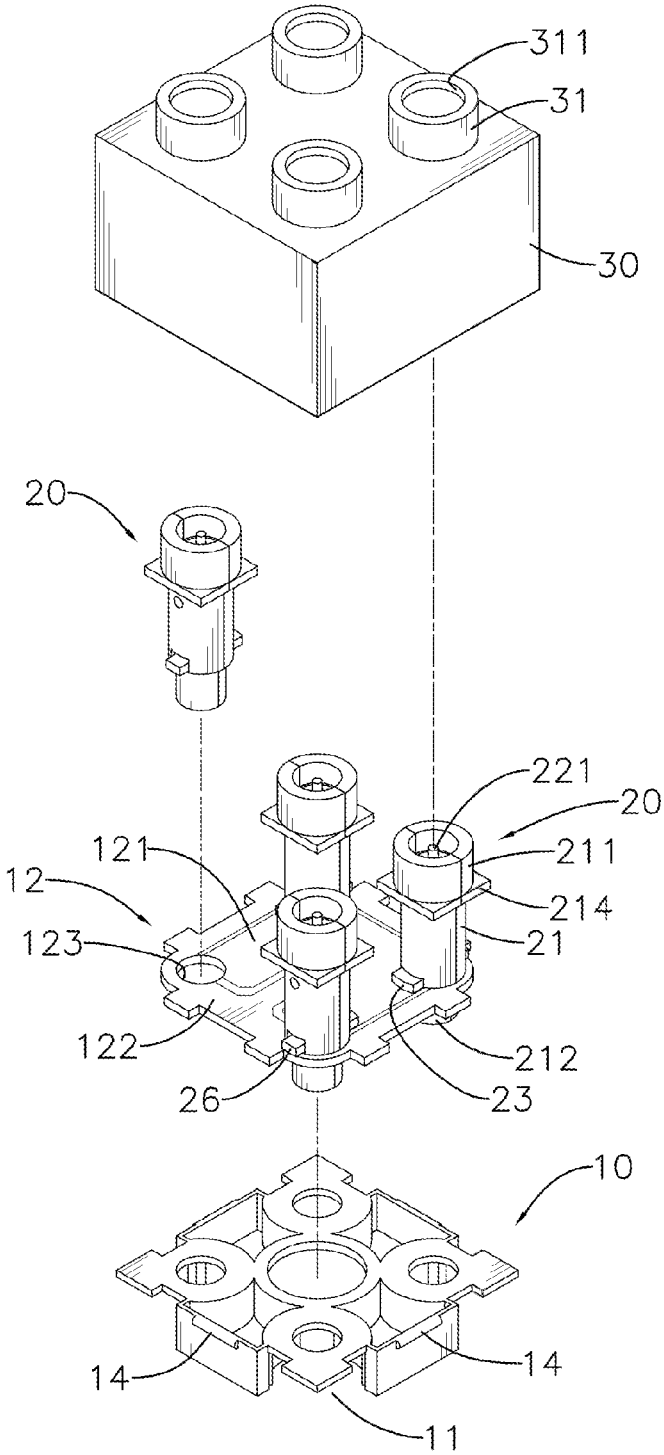
FIG. 1 is an exploded view showing a contact type of electric connection building block according to a first embodiment of the present invention.
Figure 2A:
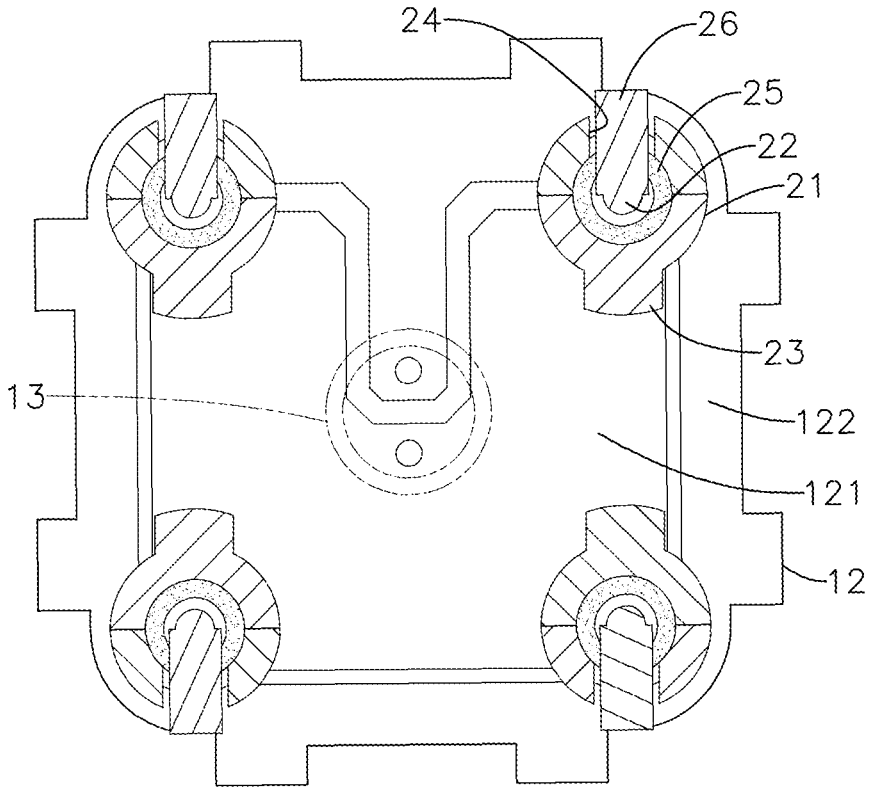
FIGS. 2A and 2B are cross-sectional views showing two embodiments of electric connection posts connected with a circuit board.

With reference to FIGS. 1 and 2A, a contact type of electric connection building block according to a first embodiment of the present invention includes a base 10, a plurality of electric connection posts 20 and a top cover 30.

The base 10 includes a plurality of recesses 11 defined in a bottom thereof and a circuit board 12 disposed on a top thereof. A first connection circuit 121, a second connection circuit 122, a plurality of insertion holes 123 and an electronic component 13 (e.g. a light member) connected with the first and second connection circuits 121 and 122 are formed on a surface of the circuit board 12.

Figure 3A:
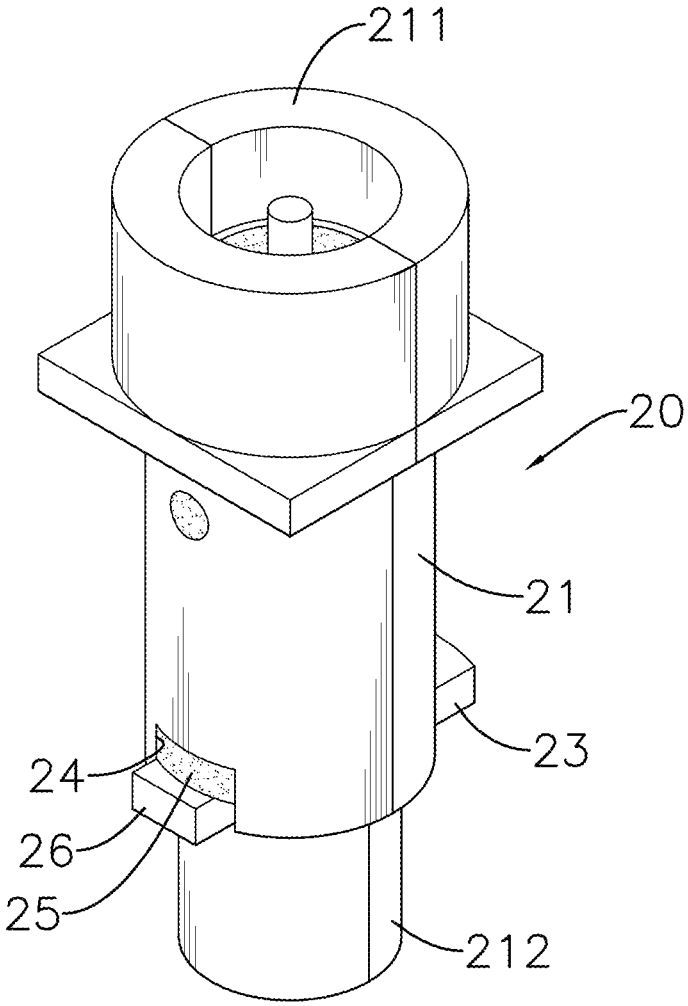
FIG. 3A is a perspective view showing the electric connection post according to the first embodiment of the present invention.
Figure 3B:
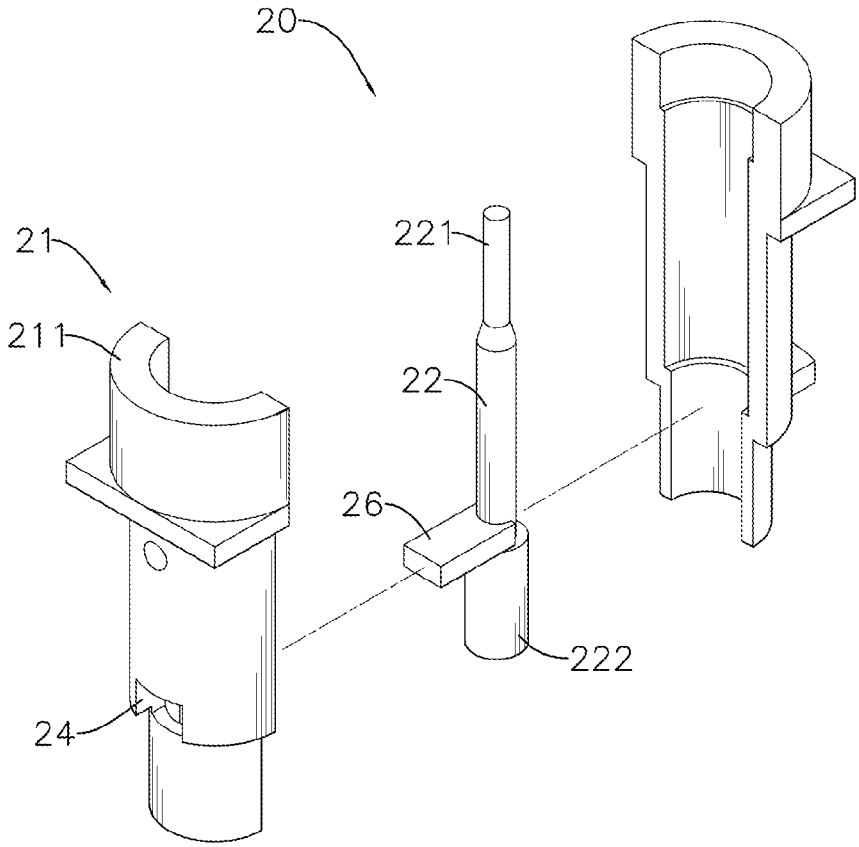
FIG. 3B is an exploded view showing the electric connection post according to the first embodiment of the present invention.
Figure 3C:
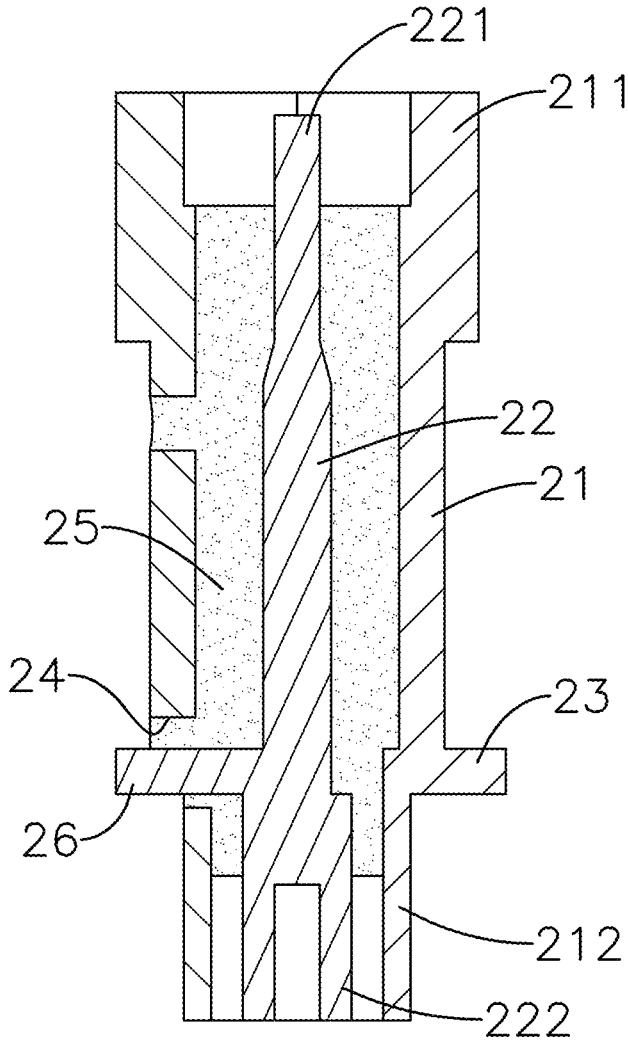
FIG. 3C is a cross-sectional view showing the electric connection post according to the first embodiment of the present invention.

The electric connection posts 20 are mounted in the insertion holes 123 of the circuit board 12 and bottoms of the electric connection posts 20 are disposed in the corresponding recesses 11. Referring to FIGS. 3A to 3C, each of the electric connection posts 20 has an exterior sheath 21 and an interior post 22 vertically disposed in the exterior sheath 21. The exterior sheath 21 and the interior post 22 are made of a conductive material. The exterior sheath 21 includes a first insertion portion 211 disposed at a top thereof and a second insertion portion 212 corresponding to the first insertion portion 211 and disposed at a bottom thereof. Similarly, the interior post 22 includes a first insertion portion 221 disposed at a top thereof and a second insertion portion 222 corresponding to the first insertion portion 221 and disposed at a bottom thereof. The exterior sheath 21 has a contact portion 23 extended outward from a wall thereof and a through hole 24 defined in the wall thereof, so that the contact portion 23 is pressed against the first connection circuit 121 of the circuit board 12. An insulator 25 is provided between the exterior sheath 21 and the interior post 22 to electrically insulate the exterior sheath 21 from the interior post 22. Furthermore, the interior post 22 is formed with a contact portion 26 corresponding to the through hole 24 of the exterior sheath 21. The contact portion 26 is projected out of the through hole 24 of the exterior sheath 21 and pressed against the second connection circuit 122. According to the first embodiment, the exterior sheath 21 is shaped in a tube. The top and bottom of the exterior sheath 21 includes the tubular first and second insertion portions 211 and 212, respectively.

Figure 4A:
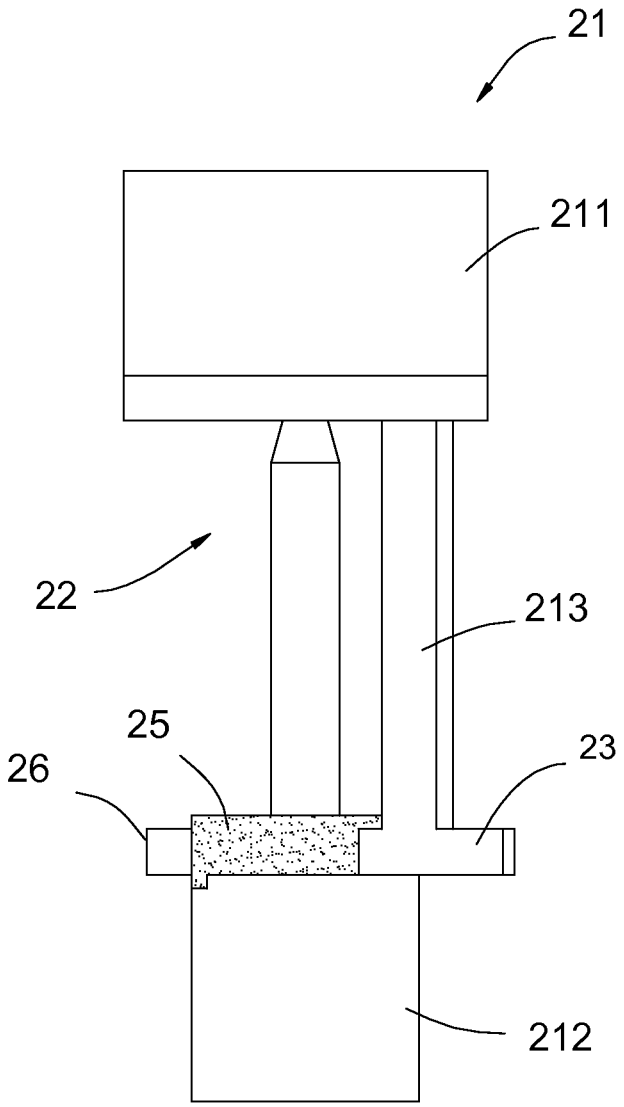
FIG. 4A is a schematic view showing an electric connection post according to a second embodiment of the present invention.
Figure 4B:
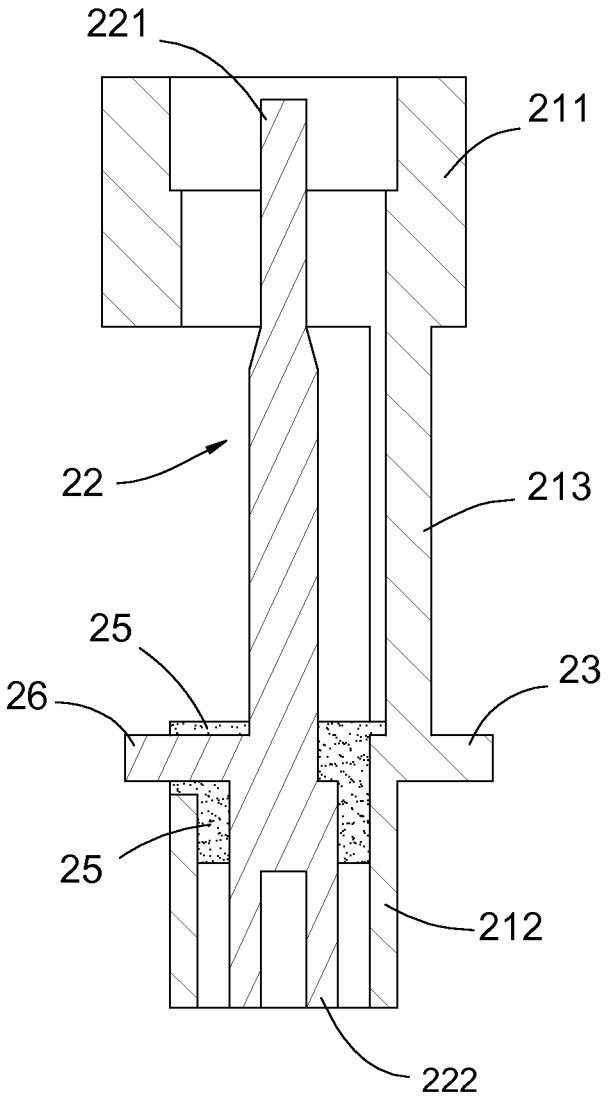
FIG. 4B is a cross-sectional view showing the electric connection post of FIG. 4A.

According to a second embodiment, the exterior sheath 21 may include the tubular first insertion portion 211, the tubular second insertion portion 212 and a connection column 213 as shown in FIGS. 4A and 4B. The contact portion 23 is extended outward from the connection column 213. The first and second insertion portions 221 and 222 of the interior post 22 are received in the first and second insertion portions 211 and 212 of the exterior sheath 21, respectively. The insulator 25 fixes the exterior sheath 21 with the interior post 22, and provides insulation between them. The contact portion 26 of the interior post 22 is projected out of the exterior sheath 21 and away from the connection column 213 of the exterior sheath 21. The second insertion portion 212 of the exterior sheath 21 is inserted into the insertion hole 123 of the circuit board 12.

Figure 5A:
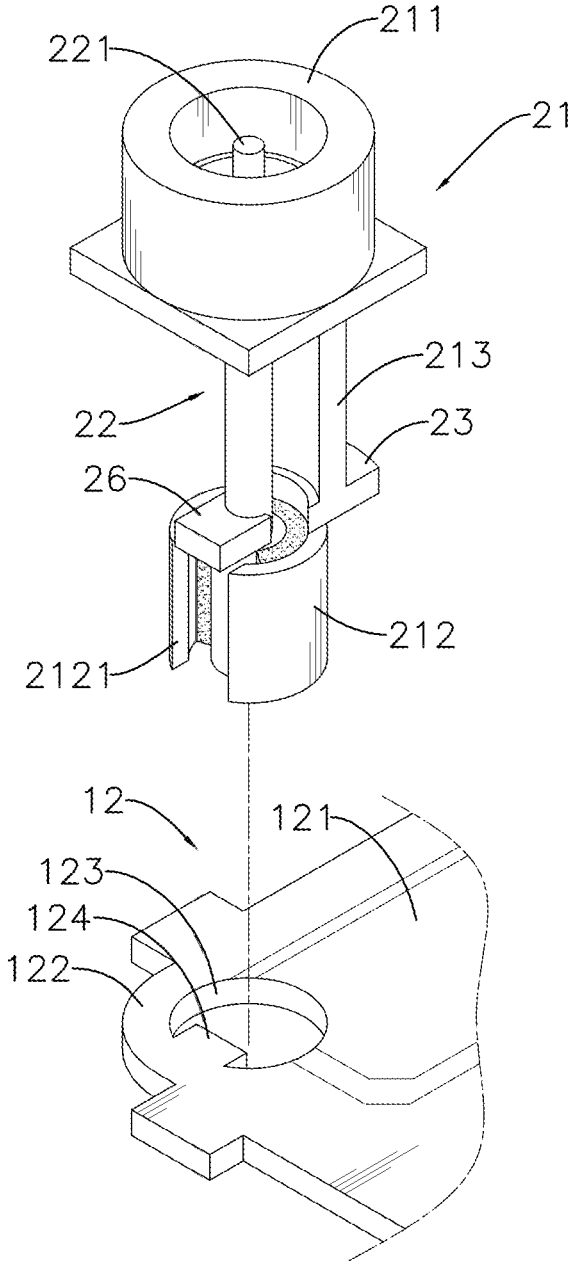
FIG. 5A is an exploded view showing an electric connection post according to a third embodiment of the present invention.

According to a third embodiment, the second insertion portion 212 of the exterior sheath 21 includes an elongated slot 2121 as shown in FIG. 5A. The insertion hole 123 of the circuit board 12 has a pressing piece 124 corresponding to the elongated slot 2121 of the second insertion portion 212. The second connection circuit 122 is extended to the pressing piece 124. Thus, when the second insertion portion 212 of the exterior sheath 21 is inserted into the insertion hole 123 of the circuit board 12, the pressing piece 124 is slid into the elongated slot 2121 of the second insertion portion 212 of the exterior sheath 21, so that the pressing piece 124 is pressed against the contact portion 26 of the interior post 22 and the contact portion 26 of the interior post 22 is contacted with the second connection circuit 122 of the circuit board 12.

Figure 5B:
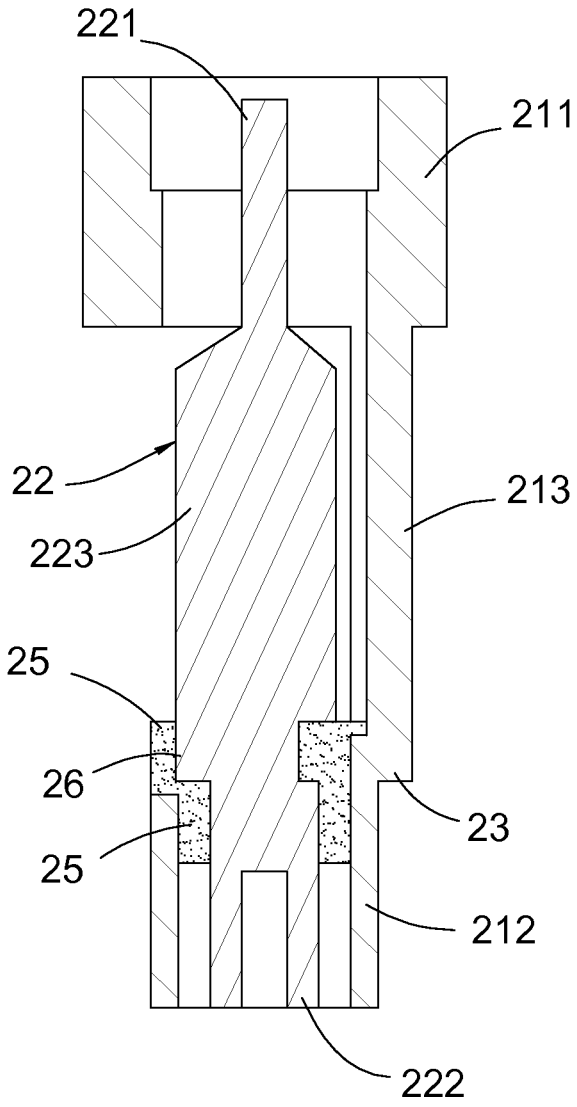
FIG. 5B is a cross-sectional view showing an electric connection post according to a fourth embodiment of the present invention.

Referring to FIG. 5B, the electric connection post 20 according to a fourth embodiment is similar to that of the third embodiment. The contact portion 23 is formed at a bottom of the connection column 213 of the exterior sheath 21. Although the contact portion 23 is not extended outward from the wall of the exterior sheath 21, a distance between an exterior surface of the contact portion 23 and a central axis of the exterior sheath 21 is greater than a distance between an exterior surface of the second insertion portion 212 and the central axis of the exterior sheath 21. Therefore, a step structure is formed between a bottom of the contact portion 23 and a top of the second insertion portion 212 of the exterior sheath 21. A middle portion 223 is disposed between the first and second insertion portion 221 and 222 of the interior post 22 and the contact portion 26 is formed at a bottom of the middle portion 223. The contact portion 26 is located at the same level with the contact portion 23 and at a side opposite to the contact portion 23. Similar to the exterior sheath 21, a step structure is formed between the contact portion 26 and the second insertion portion 222 of the interior post 22. Thus, when the electric connection post 20 is inserted into the insertion hole 123 of the circuit board 12, the contact portion 26 of the interior post 22 is pressed against the pressing piece 124 and the contact portion 23 of the exterior sheath 21 is pressed against the first connection circuit 121 of the circuit board 12.

Figure 6:
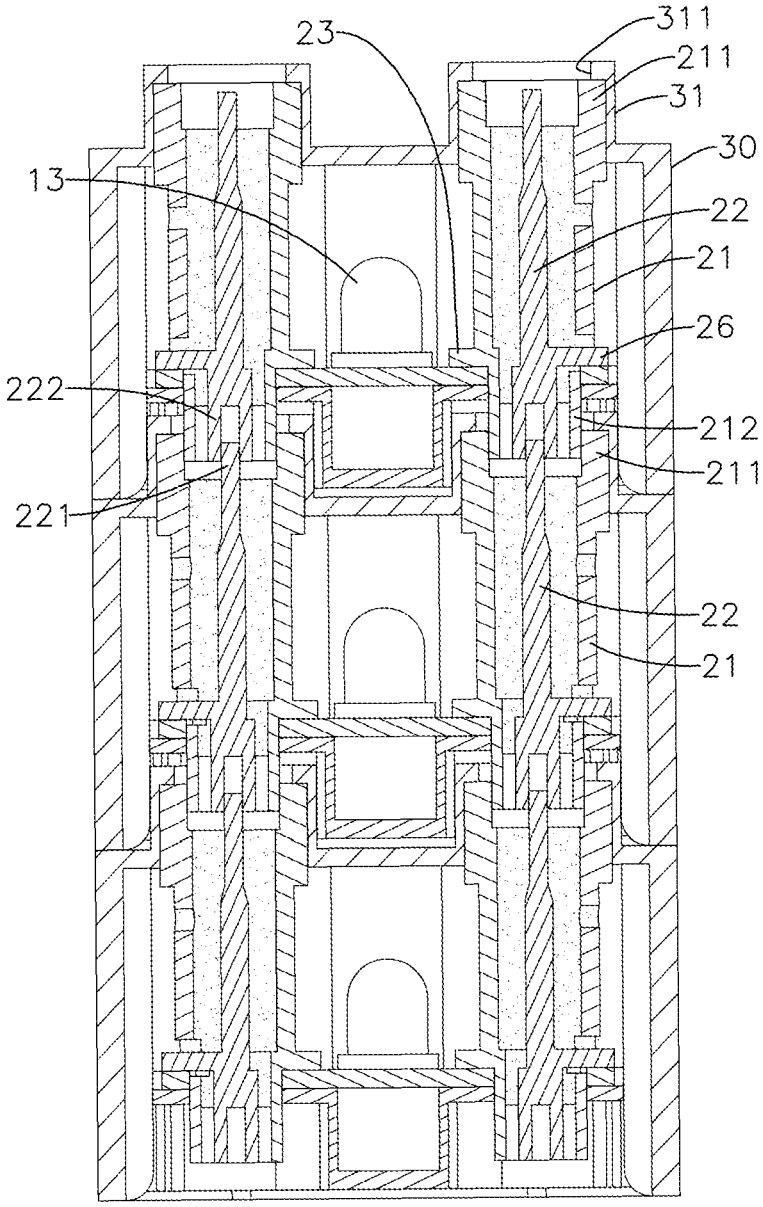
FIG. 6 is a cross-sectional view showing the connected contact type of electric connection building blocks according to the present invention.

The top cover 30 is hollow and light transmittable. The top cover 30 is mounted on the top of the base 10 and includes a plurality of hollow studs 31 disposed on a top thereof. The studs 31 correspond to tops of the electric connection posts 20 and communicate with an inner space of the top cover 30. The top of each electric connection post 20 is received in and pressed against the corresponding hollow stud 31 as shown in FIG. 6.

Figure 2B:
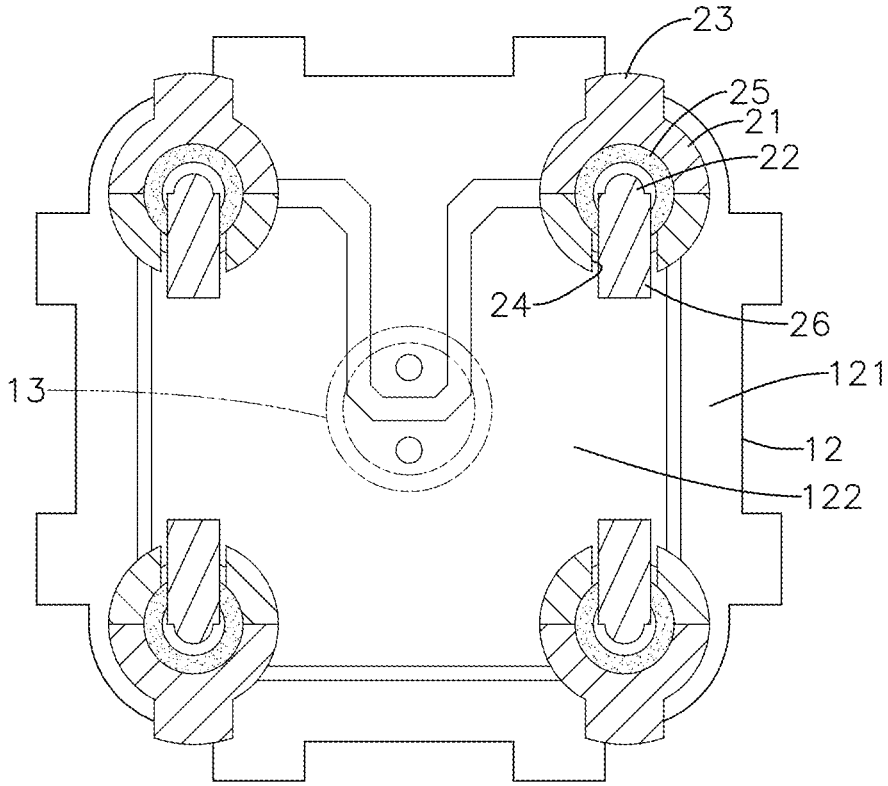

The electronic components 13 may be light members, audio members or various chips. Referring to FIG. 2A, the first connection circuit 121 is formed at a center of the circuit board 12, and the second connection circuit 122 is formed at a periphery of the first connection circuit 121 and not contacted with the first connection circuit 121. The contact portion 23 and the through hole 24 are disposed on two opposite sides of the wall of the exterior sheath 21. When the electric connection posts 20 are inserted into the circuit board 12, each contact portion 23 is facing towards the center of the circuit board 12 to be pressed against the first connection circuit 121. Each contact portion 26 of the interior post 22 is facing toward the periphery of the circuit board 12 to be pressed against the second connection circuit 122. Otherwise, the second connection circuit 122 may be formed at the center of the circuit board 12, and the first connection circuit 121 may be formed at the periphery of the second connection circuit 122 and not contacted with the second connection circuit 122, as shown in FIG. 2B. Each contact portion 26 of the interior post 22 is facing towards the center of the circuit board 12 to be pressed against the second connection circuit 122. Each contact portion 23 of the exterior sheath 21 is facing toward the periphery of the circuit board 12 to be pressed against the first connection circuit 121.

Regarding the electric connection post 20, the contact portion 23 of the exterior sheath 21 is perpendicular to the exterior sheath 21 and the contact portion 26 of the interior post 22 is perpendicular to the interior post 22. The contact portion 23 of the exterior sheath 21 and the contact portion 26 of the interior post 22 are located at the same level. Therefore, when the electric connection post 20 is mounted on the circuit board 12, the contact portion 23 of the exterior sheath 21 and the contact portion 26 of the interior post 22 are respectively pressed against the first and second connection circuits 121 and 122. The contact portions 23 and 26 may be not perpendicular to the exterior sheath 21 and the interior post 22, respectively. The contact portion 23 of the exterior sheath 21 and the contact portion 26 of the interior post 22 may be located at different levels. As long as the contact portion 23 of the exterior sheath 21 and the contact portion 26 of the interior post 22 are respectively pressed against the first and second connection circuits 121 and 122 when the electric connection post 20 is mounted on the circuit board 12. Moreover, the insulator 25 disposed between the exterior sheath 21 and the interior post 22 is an insulation paste and the insulation paste is preferred to be filled in the through hole 24 at a position that is corresponding to the contact portion 26. Therefore, the interior post 22 is fixed in the exterior sheath 21 and the contact portion 26 of the interior post 22 is separated from the exterior sheath 21 to ensure the electric insulation between the exterior sheath 21 and the interior post 22.

The first and second insertion portions 211 and 212 of the exterior sheath 21 are shaped in tubes. The first and second insertion portions 221 and 222 of the interior sheath 21 are disposed in centers of the first and second insertion portions 211 and 212 of the exterior sheath 21, respectively. An inner diameter of the first insertion portion 211 of the exterior sheath 21 is corresponding to an exterior diameter of the second insertion portion 212 of the exterior sheath 21, and therefore it allows the second insertion portion 212 of the exterior sheath 21 to be fitted into the first insertion portion 211 of another exterior sheath 21.

The first insertion portion 221 of the interior post 22 is preferred to be an insertion rod and the second insertion portion 222 of the interior post 22 is preferred to be an insertion sleeve allowing the first insertion portion 221 of another interior post 22 to be inserted thereto. Otherwise, the first insertion portion 221 may be an insertion sleeve and the second insertion portion 222 may be an insertion rod, so that the second insertion portion 222 of the interior post 22 may be inserted into the first insertion portion 221 of another interior post 22.

Figure 8:
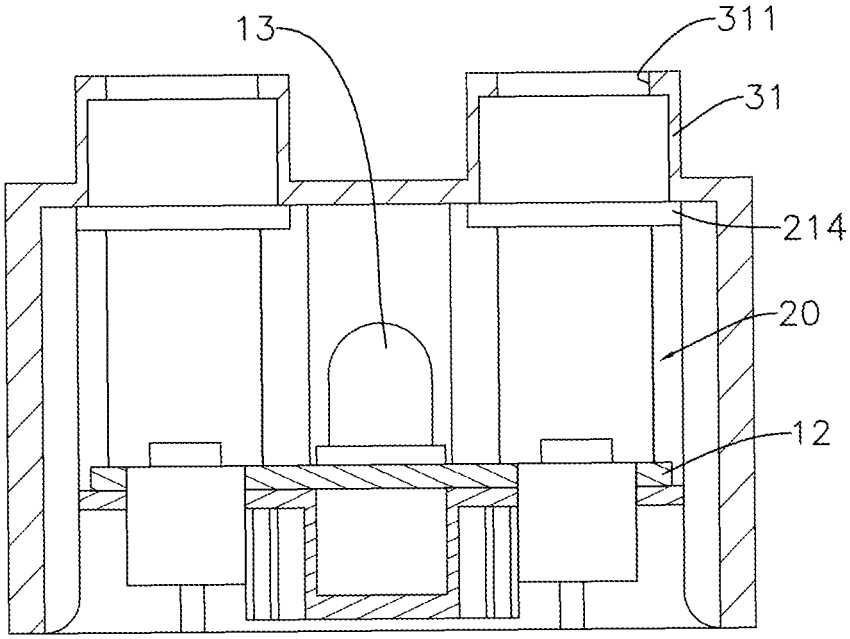
FIG. 8 is a cross-sectional view showing the stop plates and stop rings of the contact type of electric connection building block according to the present invention.
Figure 9:
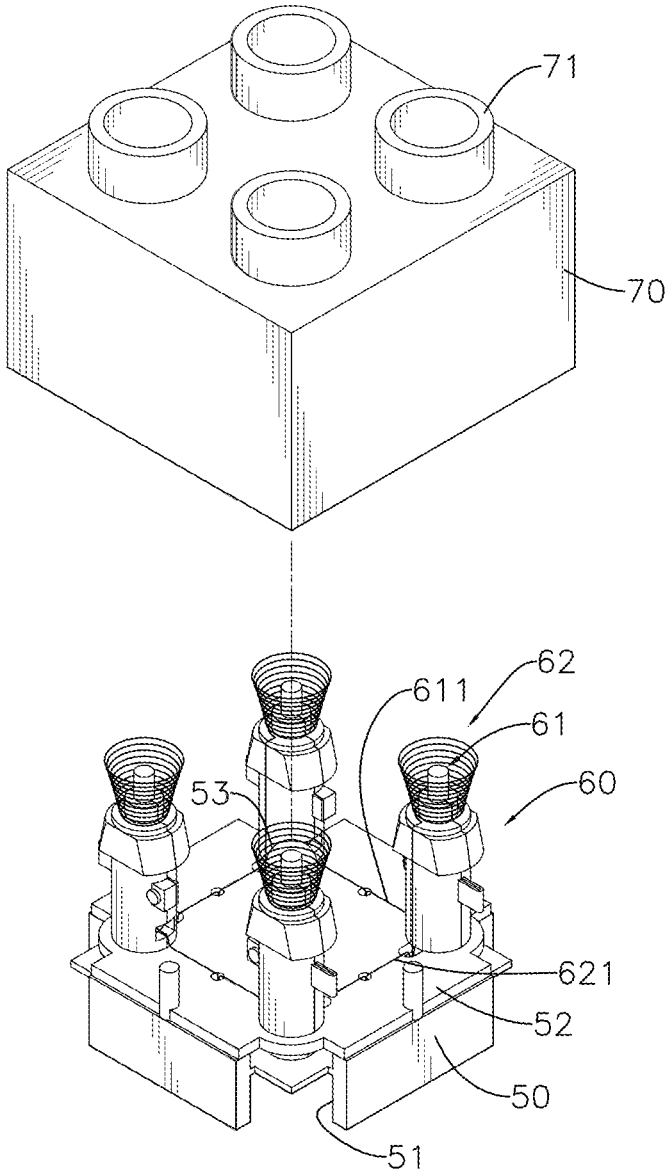
FIG. 9 (Prior Art)
FIG. 9 is an explosive view showing a conventional electric connection building block.
Figure 10:
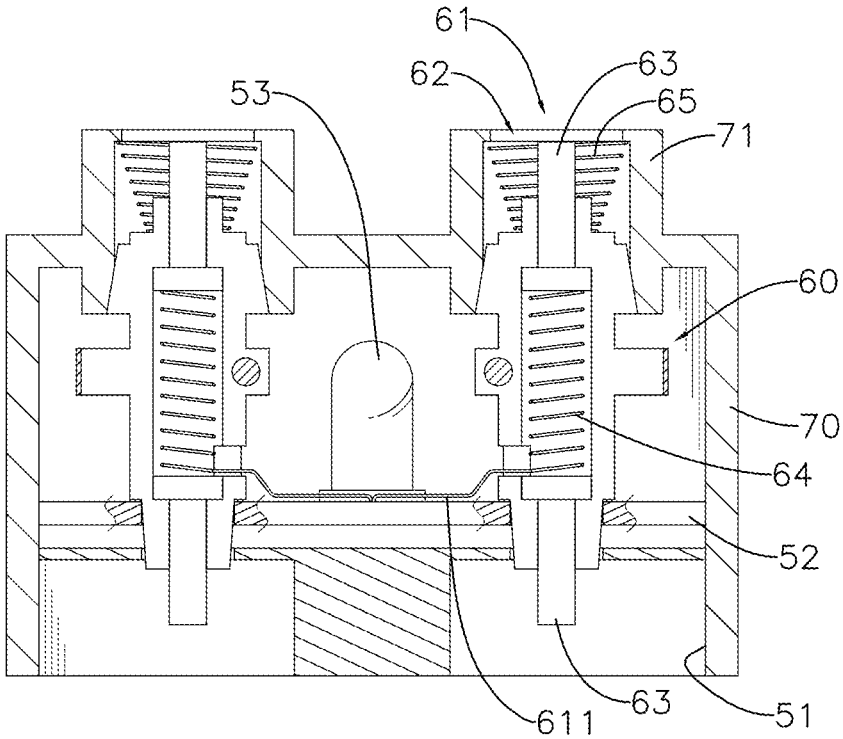
FIG. 10 (Prior Art)
FIG. 10 is a cross-sectional view showing the conventional electric connection building block.
Figure 11:
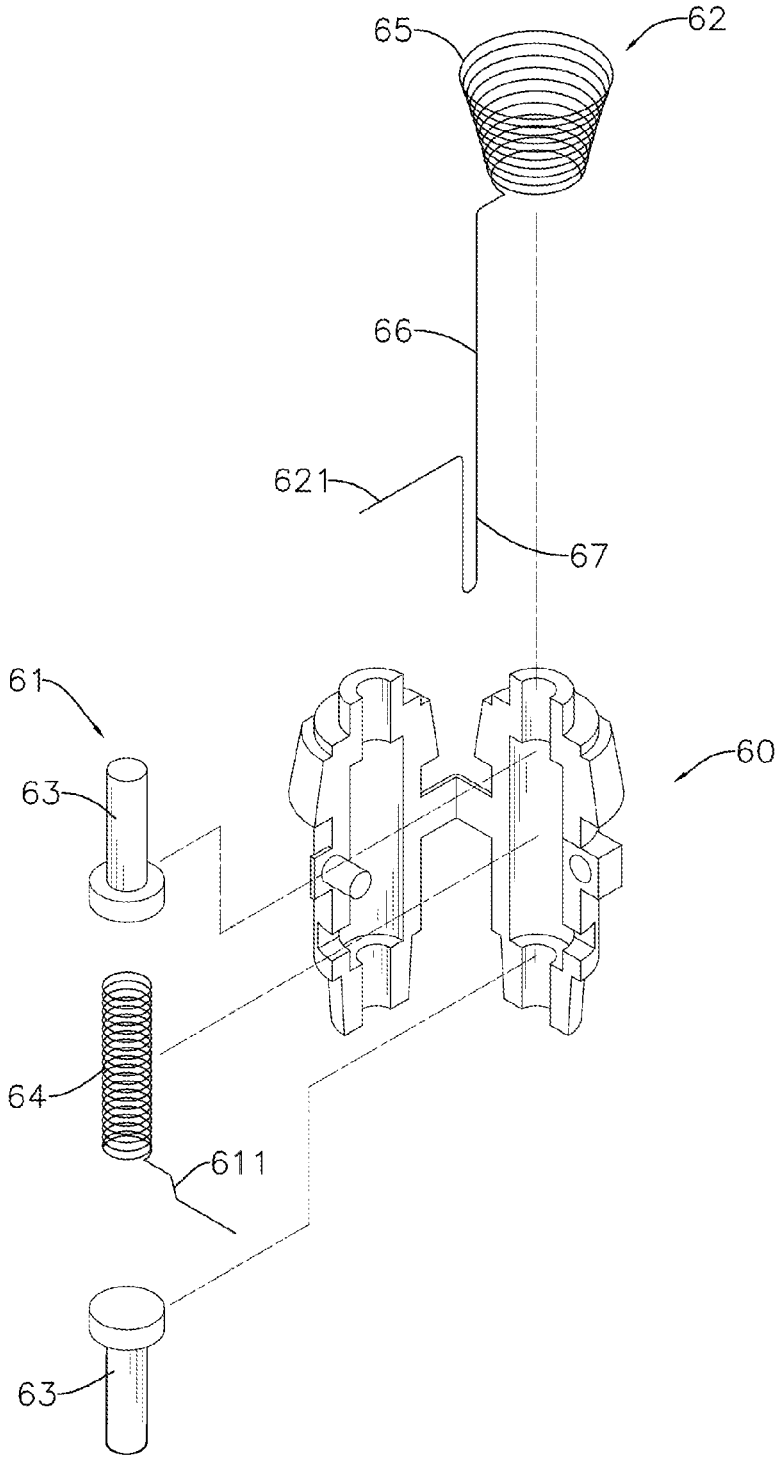
FIG. 11 (Prior Art)
FIG. 11 is an explosive view showing an electric connection post of the conventional electric connection building block.

For the top cover 30, a top of a wall of the hollow stud 31 is extended inward to form a stop ring 311 corresponding to the first insertion portion 211 of the exterior sheath 21, so that the top of the first insertion portion 211 of the exterior sheath 21 is pressed against the stop ring 311 as shown in FIGS. 1, 6 and 8. The exterior sheath 21 of the electric connection post 20 may further includes a stop plate 214 extended outward from a top of a wall of the exterior sheath 21 adjacent to the first insertion portion 211. Thus, when the first insertion portion 211 of the exterior sheath 21 is inserted into the hollow stud 31 of the top cover 30, the stop plate 214 is pressed against an inner top surface of the top cover 30.

Figure 7:
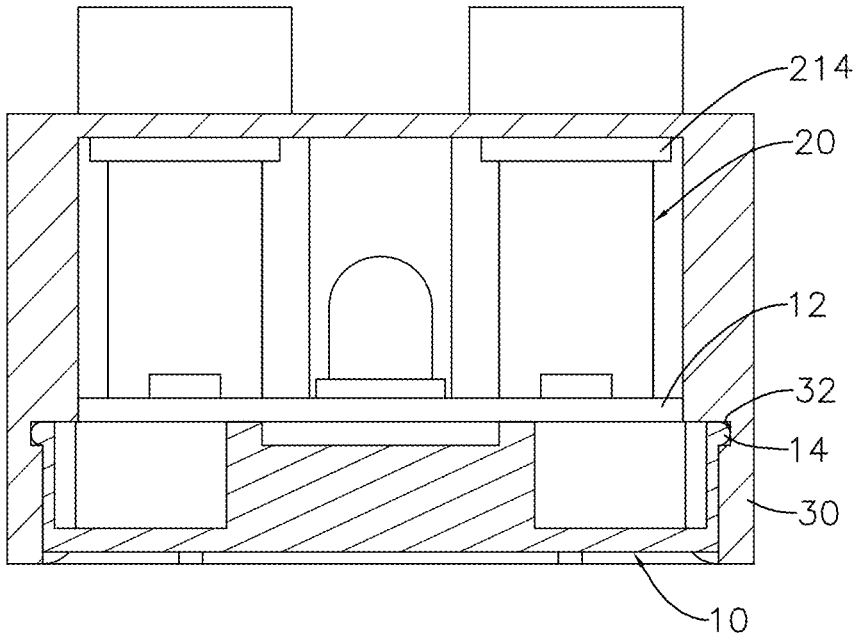
FIG. 7 is a cross-sectional view showing stop plates, engaging ribs and engaging slots of the contact type of electric connection building block according to the present invention.

Referring to FIGS. 1 and 7, the base 10 includes a plurality of engaging ribs 14 disposed at a periphery thereof and an inner wall of the top cover 30 includes a plurality of engaging slots 32 corresponding to the engaging ribs 14. The engaging ribs 14 may directly engage with the engaging slots 32 or the base 10 may connect with the top cover 30 by ultrasound welding or conductive plastics.

The exterior sheath 21 and the interior post 22 of the electric connection post 20 are preferred to be made of a conductive plastic.

Referring to FIG. 3C, when assembling the electric connection post 20, it only needs to place the interior post 22 in the exterior sheath 21 and fill the insulation paste into the exterior sheath 21 to separate the exterior sheath 21 from the interior post 22. After the insulation paste is solidified, the interior post 22 is fixed in the exterior sheath 22. Referring to FIG. 3C, when assembling the electric connection post 20 with the circuit board 12, it only needs to respectively align the contact portion 23 of the exterior sheath 21 and the contact portion 26 of the interior post 22 with the first and second connection circuits 121 and 122 of the circuit board 12 and then insert the electric connection post 20 into the insertion hole 123 of the circuit board 12. Therefore, the exterior sheath 21 and the interior post 22 become a part of an electric connection structure of the electric connection building block.

When connecting two electric connection building blocks with each other, the hollow studs 31 of a second electric connection building block are inserted into the recesses 11 of a first electric connection building block as shown in FIG. 6. The second insertion portions 212 disposed at the bottoms of the exterior sheaths 21 of the first electric connection building block are inserted into the first insertion portions 211 disposed at the tops of the exterior sheaths 21 of the second electric connection building block. The first insertion portions 221 disposed at the tops of the interior posts 22 of the second electric connection building block are inserted into the second insertion portions 222 disposed at the bottoms of the interior posts 22 of the first electric connection building block. Therefore, the first and second connection circuits 121 and 122 of the first electric connection building block is electrically connected with the first and second connection circuits 121 and 122 of the second electric connection building block by the contact connection of the electric connection posts 20.

The aforementioned electric connection post 20 of the electric connection building block uses the contact portions 23 and 26 to contact and connect with the first and second connection circuits 121 and 122 without any soldering process, which prevents the environmental contamination. Furthermore, the electric connection post 20 only needs the exterior sheath 21 and the interior post 22 to assemble. It greatly reduces the numbers of components, simplifies assembling processes and reduces assembling time.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A contact type of electric connection building block, comprising:

a base having a plurality of recesses defined in a bottom thereof and a circuit board disposed on a top thereof, the circuit board including a first connection circuit, a second connection circuit and an electronic component connected with the first connection circuit and the second connection circuit;

a plurality of electric connection posts mounted on the circuit board, a bottom of each electric connection post being received in the corresponding recess, each electric connection post having an exterior sheath and an interior post disposed in the exterior sheath, the exterior sheath and the interior post being made of a conductive material, each of the exterior sheath and the interior post including a first insertion portion disposed at a top thereof and a second insertion portion corresponding to the first insertion portion and disposed at a bottom thereof, the exterior sheath being pressed against the first connection circuit of the circuit board, an insulator being disposed between the exterior sheath and the interior post to insulate the exterior sheath from the interior post, the interior post being pressed against the second connection circuit of the circuit board; and a hollow and light transmittable top cover mounted on the top of the base, the top cover including a plurality of hollow studs disposed on a top thereof, the plurality of the electric connection posts being respectively received in the hollow studs.

2. The building block as claimed in claim 1, wherein each exterior sheath of the electric connection post comprises a contact portion corresponding to the circuit board and the contact portion of the exterior sheath is pressed against the first connection circuit of the circuit board.

3. The building block as claimed in claim 2, wherein each interior post of the electric connection post comprises a contact portion and the contact portion of the interior post is pressed against the second connection circuit of the circuit board.

4. The building block as claimed in claim 3, wherein the contact portions of the exterior sheath and the interior post are located at a same level and corresponding to the circuit board, the contact portions of the exterior sheath and the interior post are respectively pressed against the first and second connection circuits of the circuit board when the electric connection post is mounted on the circuit board.

5. The building block as claimed in claim 1, wherein each first insertion portion of the interior post is an insertion rod and each second insertion portion of the interior post is an insertion sleeve.

6. The building block as claimed in claim 1, wherein each first insertion portion of the interior post is an insertion sleeve and each second insertion portion of the interior post is an insertion rod.

7. The building block as claimed in claim 1, wherein a top of a wall of each hollow stud of the top cover is extended inward to form a stop ring to be pressed against the first insertion portion of the exterior sheath.

8. The building block as claimed in claim 1, wherein an outer wall of each exterior sheath of the electric connection post comprises a stop plate adjacent to the first insertion portion of the exterior sheath to be pressed against an inner top surface of the top cover when the first insertion portion of the exterior sheath is inserted into the hollow stud.

9. The building block as claimed in claim 1, wherein the base comprises a plurality of engaging ribs disposed at a periphery thereof and an inner wall of the top cover comprises a plurality of engaging slots corresponding to the engaging ribs, the engaging ribs are engaged with the engaging slots to connect the base with the top cover.

10. The building block as claimed in claim 1, wherein the base is connected with the top cover by ultrasound welding.

11. The building block as claimed in claim 1, wherein the base is connected with the top cover by conductive plastics.

* * * * *